US006150940A

United States Patent [19]

Chapman et al.

[11] Patent Number: 6,150,940

[45] Date of Patent: Nov. 21, 2000

[54] ANTI-THEFT ELECTRICAL POWER CORD

[76] Inventors: Glenn H. Chapman, 637 Ebert Avenue, Coquitlam, British Columbia, Canada, V3J 2L1; Mark Zaacks, 9666 Sixth Street, Sidney, British Columbia, Canada, V8L 2W3

[21] Appl. No.: 09/371,800

[22] Filed: Aug. 10, 1999

[51] Int. Cl.[7] ..... G08B 13/14

[52] U.S. Cl. ..... 340/568.3; 340/568.2; 340/571; 340/657; 340/687; 200/61.59

[58] Field of Search ..... 340/568.2, 568.3, 340/657, 571, 687; 200/61.59

[56] References Cited

U.S. PATENT DOCUMENTS

| | | | |
|---|---|---|---|
| 3,537,095 | 10/1970 | Cones | 340/568.3 |
| 3,618,065 | 11/1971 | Trip et al. | 340/568.3 |
| 4,680,574 | 7/1987 | Ruffner | 340/571 |
| 4,736,195 | 4/1988 | McMurtry et al. | 340/568.3 |
| 4,945,341 | 7/1990 | Buttimer | 340/568.3 |
| 5,059,948 | 10/1991 | Desmeules | 340/568.3 |
| 5,243,328 | 9/1993 | Lee et al. | 340/568.3 |
| 5,418,521 | 5/1995 | Read | 340/568.3 |
| 5,525,965 | 6/1996 | Liebenthal | 340/568.3 |
| 5,818,345 | 10/1998 | Sjooquist | 340/825.31 |

*Primary Examiner*—Benjamin C. Lee
*Attorney, Agent, or Firm*—Weide & Associates, Ltd.

[57] ABSTRACT

An anti-theft power cord for use with electrical devices has sensors for detecting removal of the cord from an electrical receptacle and for detecting the removal of the cord from the device sought to be protected. Control systems associated with each of the sensors activate alarms when receiving signals from the sensors. The control systems, comprising microcontrollers, also communicate with one another along the power cord and will sound an alarm if the cord is cut. A battery backup system is provided to allow the power cord to function as an anti-theft device even during a power failure without sounding false alarms.

25 Claims, 4 Drawing Sheets

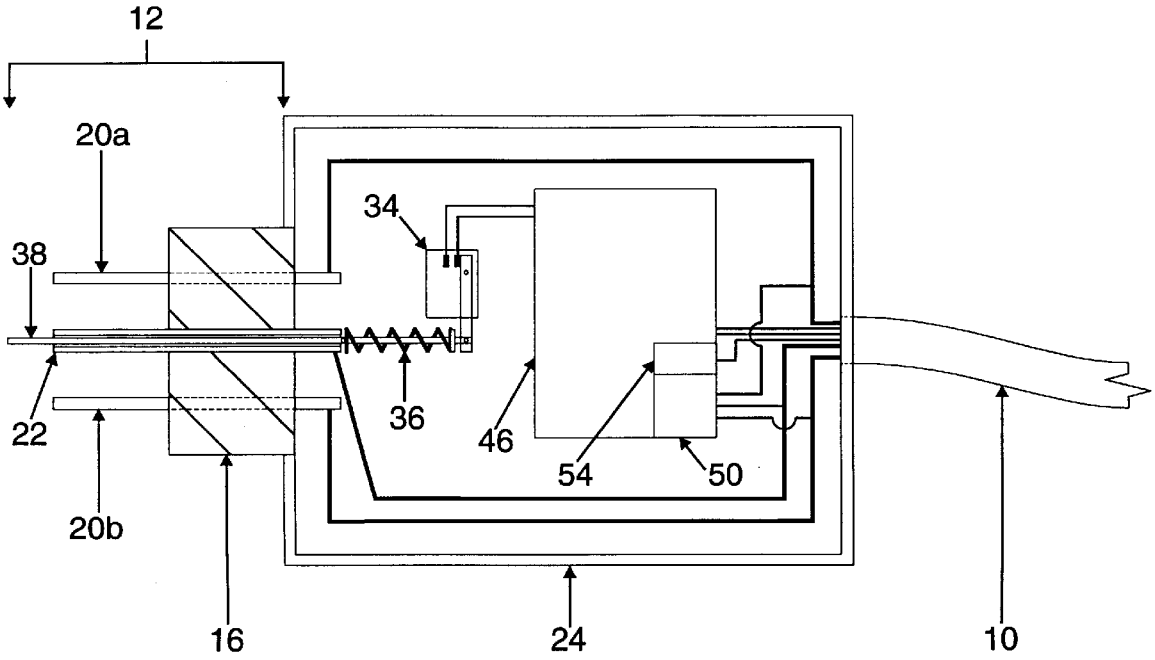
FIG. 3a
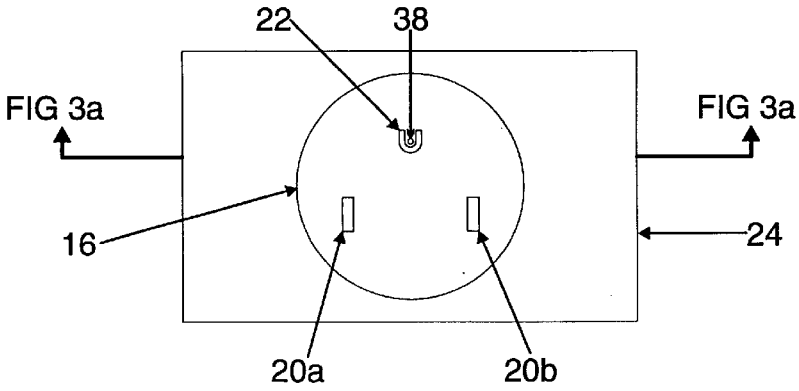
FIG. 3b
FIG. 3

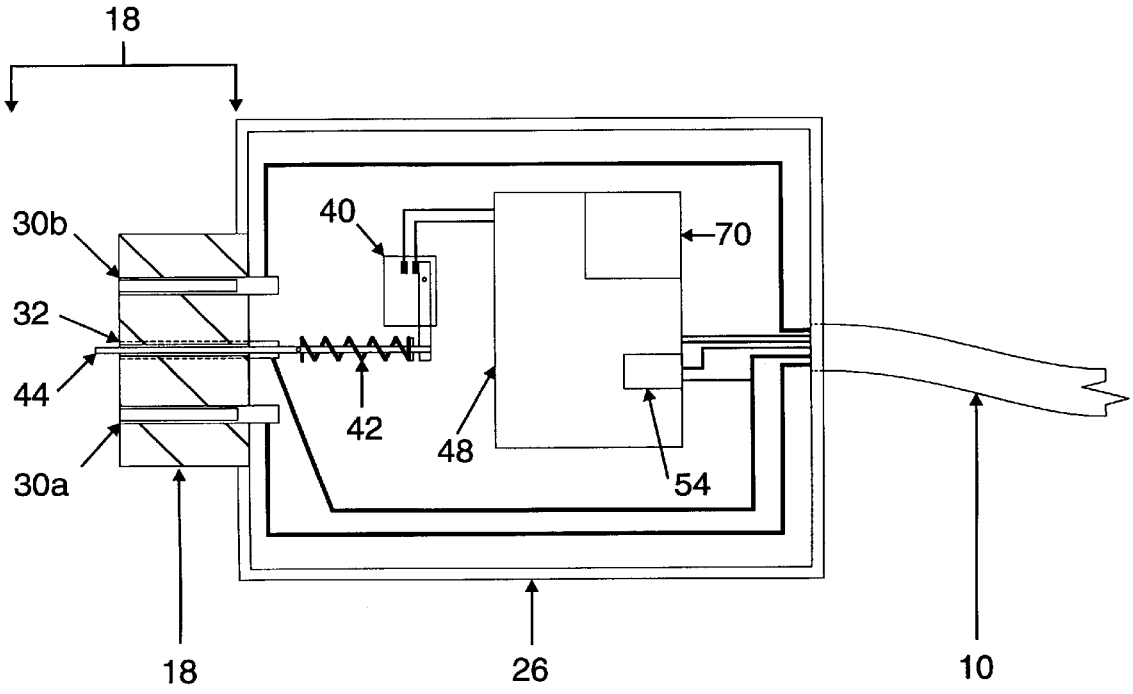
FIG. 4a
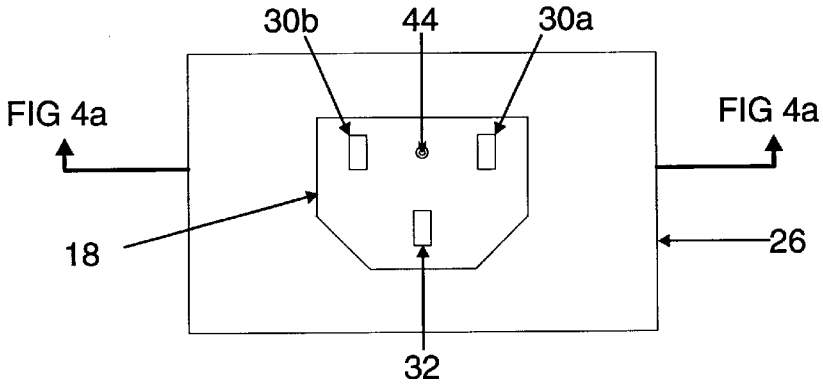
FIG. 4b
FIG. 4

ANTI-THEFT ELECTRICAL POWER CORD

TECHNICAL FIELD

This invention relates to electrical power cords, and more particularly to power cords having integrated within them features which deter theft of electrical equipment such as computers by sounding alarms when such equipment is removed.

BACKGROUND

Theft of electrically-powered equipment such as computers and related equipment such as monitors and printers, consumer home electronics such as televisions and VCR's, and scientific laboratory equipment has become a major problem in homes, businesses, and universities. This has led to the development of a large variety of security systems for the prevention of theft of such equipment.

There exist varyingly-effective general security systems which may detect the unauthorized entry of a person into a given area where such equipment is stored. Many of these systems employ motion detectors or heat detectors. However, these systems do not detect the removal of a specific piece of equipment. Security systems for individual items of equipment has ranged from detection of the removal of electrical power, to internal motion sensors with alarms, to cables which when moved alert a central alarm system. Most of these individual security systems however make regular use of the equipment more difficult, since false alarms are frequent when such equipment is slightly moved even by the authorized user.

Of course, there are relatively unsophisticated solutions to keeping a specific piece of equipment from being stolen, such as simply chaining down the equipment, but these are not convenient in all situations (for example, most homeowners are unlikely to lock their televisions in chains). Furthermore, once removed from such mechanical locking systems, such equipment can be freely used by the thief.

Because of the great need, numerous more sophisticated systems have been developed which allow the detection of theft of electrical equipment. All have their disadvantages, however.

Many of these prior art systems generally detect the connection of the equipment to an electric receptacle. In particular, many such security devices and systems have focused on the detection of electrical signals from the main power supply to the electrical device. For example, U.S. Pat. Nos. 4,945,341, 5,059,948 and 5,525,965 show a variety of systems where changes in the electrical state of the device are monitored. These systems have significant disadvantages which limits their usefulness.

For example, many such systems cannot distinguish power loss caused by removal of a power cord from a receptacle from power loss caused by a power outage or power failure. Since such power failures, even on a momentary basis, occur often, such systems provide many false alarms which may be not only be inconvenient but may also cause a security company or the Police to be less diligent in their monitoring of such alarms. Frequent false alarms require that such systems be reset often. Moreover, such false alarms due to power failures may occur when the users are not near the equipment, causing batteries to drain, limiting their future effectiveness.

Another example is the device disclosed in U.S. Pat. No. 5,418,521, which issued on May 23, 1995 to R. Read. Read discloses an extension cord-like power cable intended to be used with power tools to detect and signal their removal from the cord. In one embodiment of the Read cable, the male end thereof is plugged into an electrical socket in a normal fashion. The cable has a switch integrated into one current slot of the female socket.

The cable also has an integrated alarm which sounds when the tool is removed from the female socket of the cable. The switch is open when the tool is plugged-in, and closes when the tool is removed, closing a circuit which activates the alarm. In another embodiment, the male end of the cable has a similar switch to detect removal of the plug from the receptacle.

This cable and others like it, though, have many limitations which render them unsatisfactory for use in a home or office to prevent theft of electrical equipment such as a computer.

First, the Read cable is clearly intended to be used only in situations where the tool is far removed from the receptacle (ie. where the cable is long) since simply unplugging the cable from the receptacle defeats the alarm, at least in its simpler embodiment where there is no switch at the male end of the cable. Moreover, in some embodiments of Read's cable it appears that cutting power to the female end of the cable (for example, by turning off the alarm control switch near the male end of the cable or by turning off the power at the receptacle and merely cutting the cable between the female socket and the alarm) will prevent the alarm from sounding. This renders the cable useless where a determined thief is willing to chance cutting a live electrical cord.

Moreover, the switches used in the Read cable, particularly the one used at the male end, are easily manipulated or defeated by inserting a thin card, for example, between the switch and the receptacle. Also, the alarm is transitory and sounds only when the switches are closed; a thief need only quickly replace the power tool plug with another plug in the female socket, for example, to shut the alarm off. This might take a second, at most.

Also, in one embodiment there is no way to deactivate the alarm without unplugging the cable from the electrical outlet, so even the authorized power tool user will set off the alarm by switching power tools, at least until the new tool is plugged in, unless the cable is first unplugged at the receptacle. Finally, although there is one embodiment of the Read invention which does have a switch to deactivate the system, this switch is easy for a thief to find, rendering the system useless.

There are other very complicated security systems which have been suggested. For example, U.S. Pat. No. 4,680,574 discloses an appliance anti-theft system which uses time domain reflectrometry to determine when the length of the power cord has been altered, for example, by cutting. However, such systems are very complicated and expensive.

There remains, accordingly, a need for a theft detection system conveniently forming a power cord for an electrical device which has the following elements:

1. the ability to detect the removal of the cord from an electric receptacle, and also possibly the removal of at least a portion of the cord from the electrical device (such a cord may have a female end which the electrical device is plugged into, or may be itself built into the electrical device);
2. an integral alarm which is activated by removal of the device from the cord, or the removal of the cord from the receptacle;
3. a system for deactivating the alarm to allow authorized removal of the cord from the receptacle and the device from the cord;

4. the ability to distinguish between a lack of electrical conduction in the cord caused by removal from the receptacle, and that caused by the lack of source electricity (for example, caused by a power outage);
5. the ability to detect the cutting of the cord;
6. a mechanical configuration which does not allow manipulation of the sensing switches of the device; and
7. a low production cost;

SUMMARY OF INVENTION

The present invention provides a theft-deterring electrical power cord for use with electrical equipment such as computers. The power cord has a typical male plug having first and second current prongs and typically a grounding prong for plugging the cord into an electric receptacle. It also has a second end which may be a female socket having first and second current slots and a ground slot, fashioned to accept a power cord of said electric device.

The cord integrates two sensors, one of which senses the removal of the cord from the receptacle and causes a control system to sound an alarm, preferably an audio alarm, when the cord is removed. The other sensor senses removal of the cord from the device sought to be protected against theft, and similarly causes a control system to sound an alarm. In a preferred embodiment, the control systems communicate with one another, and sound an alarm when such communication ceases, this being indicative of the cutting of the power cord.

The first sensor may comprises a rod protruding from the plug, one end of the rod being attached to a microswitch encased within the plug. In this instance, the microswitch is electrically coupled to the control system, which may comprise a microcontroller. This rod is reciprocable between an extended position and a retracted position. In one of these positions the rod mechanically causes the microswitch to close. For safety's sake, the rod is preferably sheathed within the grounding plug.

In one embodiment of the invention, the power cord also incorporates means for deactivating the alarm-producing abilities of the cord. This may conveniently be accomplished by an infrared device such as a remote control.

Normally, the electrically-powered components of the power cord draw power from the electrical receptacle, but a battery backup system would preferably also be provided to provide back-up power when there is a power failure.

A similar sensor may be incorporated into a second end of the cord where that end comprises female socket having first and second current slots and a grounding slot, the socket fashioned to be connected to an electrical device. In this case, the second sensor comprises a second rod protruding from the female socket and a first end of the second rod is attached to a microswitch encased within the socket.

Of course, other types of sensors, like optical and acoustical sensors sensing distances may be utilized.

BRIEF DESCRIPTION OF DRAWINGS

In drawings which illustrate specific embodiments of the invention, but which should not be construed as restricting the spirit or scope of the invention in any way:

FIG. 3*a* is a cross-sectional schematic view of the male plug portion of the cord shown in FIG. 1.

FIG. 3*b* is an end view of the male plug portion of the cord shown in FIG. 1.

FIG. 4*a* is a cross-sectional schematic view of the female plug portion of the cord shown in FIG. 1.

FIG. 4*b* is an end view of the female plug portion of the cord shown in FIG. 1.

DESCRIPTION

Figure 1:
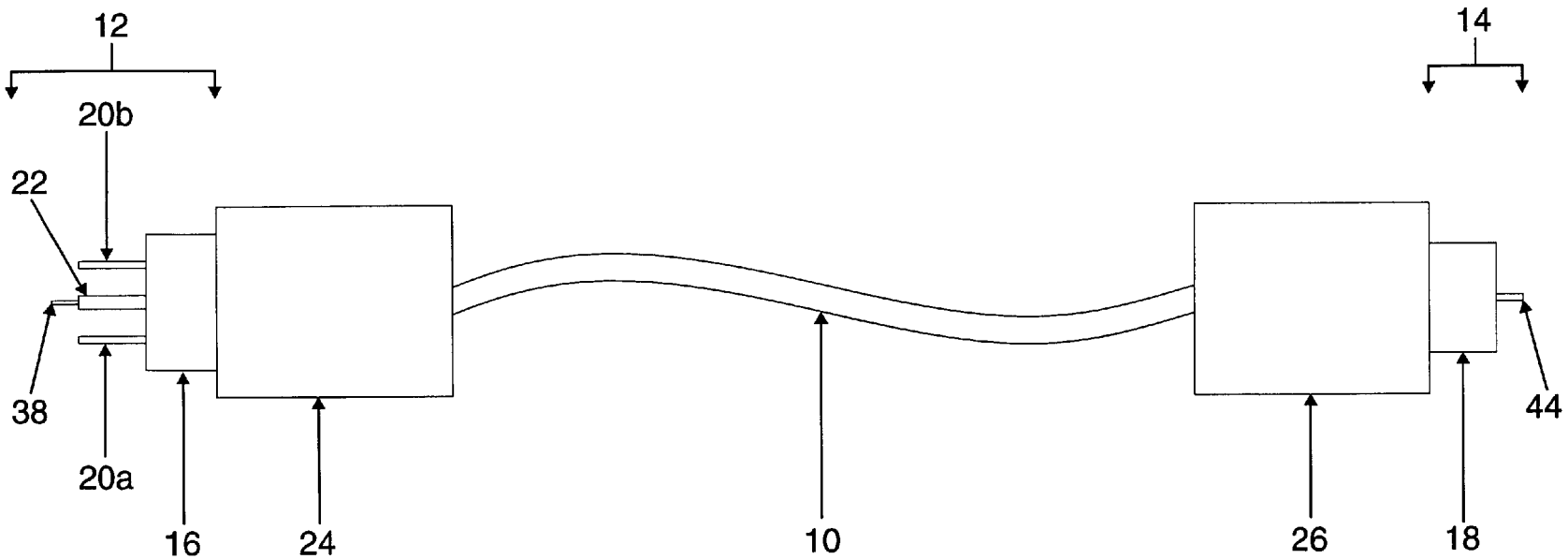
FIG. 1 is a schematic view of the power cord of one embodiment of the present invention.

Referring to FIG. 1, a power cord made in accordance with one embodiment of the invention, denoted generally by the numeral 10, has, generally, a first end 12 and a second end 14. First end 12 comprises a male plug 16 for plugging cord 10 into an electric receptacle (not shown).

Second end 14 may comprise a socket 18 fashioned to accommodate male plug 16 of the power cord of an electrical device. In this manner, cord 10 acts as an extension cord. In the case of some equipment which has other types of power prongs, such as a computer CPU or other computer case which might have a recessed male connector to which a power cord is typically connected, cord 10 may be fashioned as a power cord. Alternatively, second end 14 may simply be wired directly into an electrical device, cord 10 thereby forming the electrical device's own power cord. First end 12 is typically connected to second end 14 by standard PVC 3-conductor electrical cable.

Male plug 16 has typical first and second power prongs 20*a*, 20*b*, and may have a grounding prong 22. Plug 16 is generally fashioned to plug into a typical electric receptacle. Female socket 18 has corresponding first and second slots 30*a*, 30*b* and may have a grounding slot 32 (FIGS. 4*a* and 4*b*).

Closely associated with each of male plug 16 and female socket 18 are sensors which sense either that a plugged-in cord has been unplugged from the receptacle, or that the electrical device has been unplugged from female socket 18 of cord 10 (where the cord has a female socket and acts as an extension cord), or that cord 10 has been otherwise removed from the device (where cord 10 forms the device's own power cord), or otherwise rendered inoperative.

While it is simple to check for the AC level across plug 16 to determine whether cord 10 is unplugged, this method is unreliable since it is important for cord 10 to function even during power outages.

The sensors, therefore, must be somewhat more sophisticated in nature than simple electrical detectors. Two possible options are to use either optical or acoustic distance sensors to determine when plug 16 or socket 18 is separated from its connection. Such active detectors have disadvantages, however, when compared to the passive mechanical sensors discussed below, since they consume much more power than mechanical sensors. Also, these systems can be easily defeated if a card is placed in front of such detectors, so in a preferred embodiment mechanical sensors (as shown in FIGS. 3*a* and 3*b*, and 4*a* and 4*b*) are used.

FIGS. 3*a* and 3*b* illustrate a preferred sensor arrangement for use in association with plug 16 of cord 10. In this arrangement, a mechanical microswitch 34 is encased within plug 16 of cord 10. An electrically-insulated rod 38 is attached to the actuator of microswitch 34 by a spring 36. Rod 38 protrudes outwardly from the interior of plug 16, perhaps through one of prongs 20*a*, or 20*b*, but preferably through grounding prong 22. Rod 38 is reciprocable between two positions, an extended position, in which microswitch 34 is closed, and a retracted position, in which microswitch 34 is open. Spring 36 normally biases rod 38 into its extended position.

It is well known that electric receptacles have back portions. It will be appreciated by those skilled in the art that when plug 16 of cord 10 is plugged into such a receptacle, the outer end of rod 38 collides with the back of the receptacle. Rod 38 is pushed into plug 16, into its retracted position, when plug 16 is plugged into the receptacle. In this position, microswitch 34 is open. When plug 16 is removed from the receptacle, rod 38 is urged into its extended position by spring 36, and when rod 38 comes to a predetermined point, which need not be its entirely extended position, microswitch 34 closes. Preferably, this predetermined position is reached before plug 16 is removed entirely from the receptacle so that a card or some similar device cannot be placed between plug 16 and the receptacle and so the rod cannot otherwise be tampered with. The only way this system could be defeated would be to remove the receptacle, which is time consuming and dangerous.

As will be appreciated, the closing and opening of microswitch 34 provides an opportunity to send signals concerning the state of plug 16, and cord 10, to a control system, as discussed below.

FIGS. 4*a* and 4*b* illustrates a preferred sensor arrangement for use in association with female socket 18 of cord 10. This is a similar arrangement to that described above relating to plug 16. A second microswitch 40 is encased within socket 18 of cord 10. A rod 44 is attached to the actuator of microswitch 40 by a spring 42. Rod 44 protrudes outwardly from the interior of socket 18. Rod 44 is reciprocable between two positions, an extended position, in which microswitch 40 is closed, and a retracted position, in which microswitch 40 is open. Spring 42 normally biases rod 44 into its extended position.

Again, it will be apparent that rod 44 may be pushed back into socket 18 by the face of the plug on the power cord of the electrical device sought to be protected. In its retracted position, rod 44 opens microswitch 40. When socket 18 is unconnected from the electrical device, rod 44 moves to its extended position, closing microswitch 40. Again, microswitch 40 is preferably closed by the action of rod 44 before socket 18 is entirely unconnected from the device's power cord.

It is of course preferable that the sensor rods be connected to the ground line, and that the switches used are be electrically-insulated so that no electrical danger is presented by the system. Other mechanical sensors, such as rods or springs on the side of the ground prong which are depressed by the socket walls and activated by the prongs removal, are well known to practitioners of the art. Additional configurations are possible, such as sensors on the power prongs themselves, but are not thought to be as efficient, being more easily defeated or more dangerous.

As noted above, the respective microswitches communicate their status to a control system by closing some electric circuit. The transmission of these electrical "alarm" signals may be accomplished either along the power cord's existing wires, or along added signal carrying means such as additional wires or fiber-optical cables (not shown).

Figure 2:
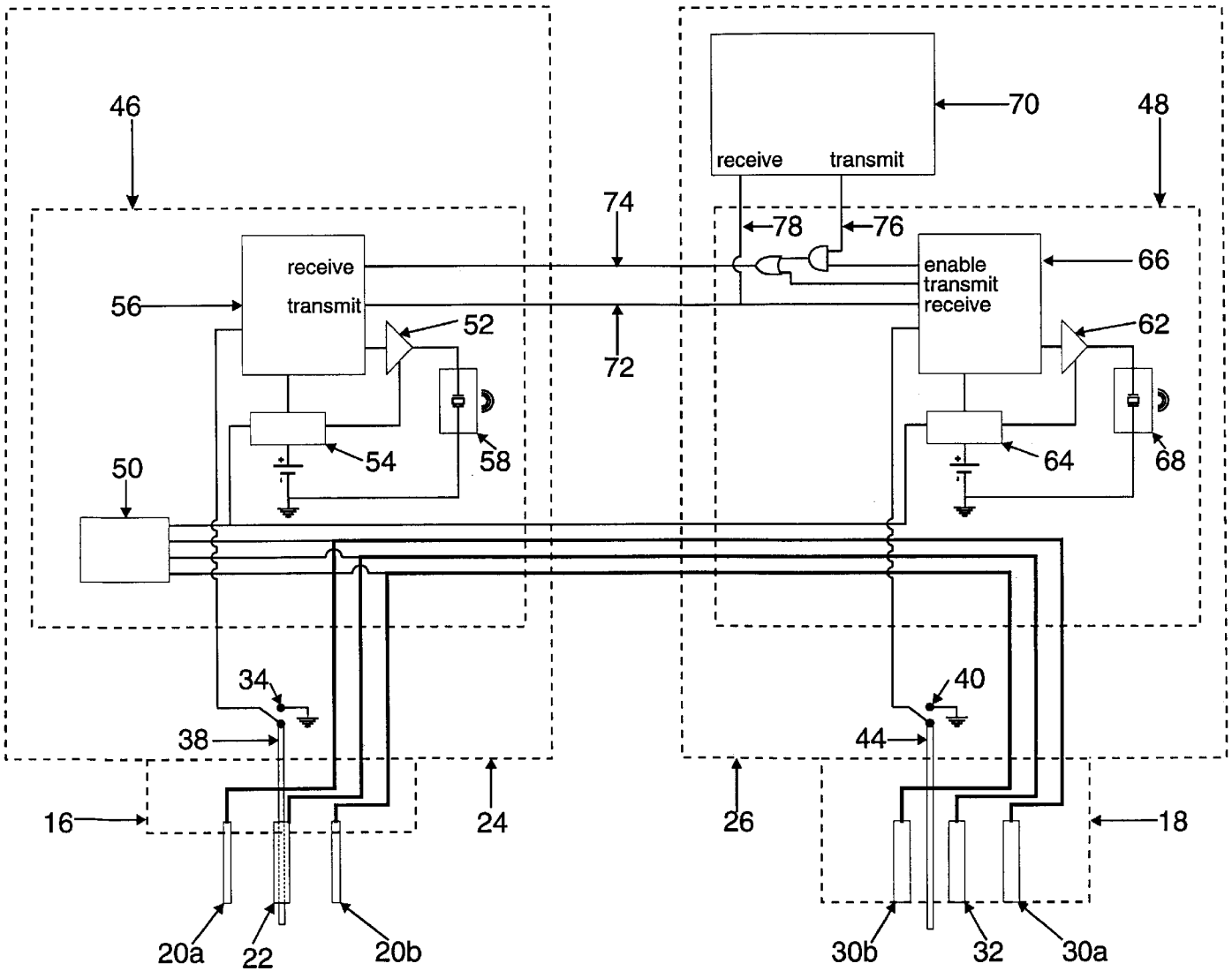
FIG. 2 is a schematic block wiring diagram of one embodiment of the invention.

In one embodiment, control systems 24, 26 (FIG. 1) are electrically coupled to the sensors, and are preferably proximate plug 16 and socket 18 respectively. Specifically, control system 24 is connected to receive signals from the sensor containing microswitch 34, and control system 26 receives signals directly from the sensor containing microswitch 40. FIG. 2 is a wiring diagram showing the components of the system of the preferred embodiment.

Upon receiving an alarm signal from its respective sensor, control systems 24, 26 activate an alarm. A single alarm may be used, but preferably, two alarms are used (as shown in the wiring diagram of FIG. 2), one integrated into each of control systems 24, 26. While a single alarm system will work, using a simple separate wiring system, it is more vulnerable to being bypassed by separating out the signal from the power wires by splitting the power cord, by cutting the cord, or by simply breaking the male plug, destroying the alarm at one end, depending on the signalling system used.

The alarm signal produced by the alarms associated with cord 10 may be any traditional acoustic, electronic, electromagnetic or optical signal. However, it is foreseen that it may be favourable for the alarm to be a two-tone acoustical signal. Such a signal can be easily detected by not only a human alarm monitor but also by an existing general security system, or an autodialler programmed to dial a security company or the Police. Also, such an audio alarm would be noticed by the prospective thief, tending to discourage the theft. Again, any alarms associated with cord 10 are preferably self-contained within cord 10 itself, so that cord 10 can be used with different pieces of equipment if it is fashioned as an extension cord or computer power cord.

Preferably, control systems 24 and 26 are able to communicate directly with one another indicating to each other the status of the respective ends of cord 10, so that cord 10 cannot simply be cut to avoid activating the alarms.

In the preferred embodiment, as shown in FIG. 2, one control system acts as a master module 46 and the other as a slave module 48. Power supply circuitry 50, which may typically include a transformer, a rectifier and a voltage regulator, is provided in one module. Master module 46 and slave module 48 may contain, respectively, an alarm amplifier circuit 52, 62, battery backup circuitry 54, 64, alarm acoustic emitters 58, 68, and microcontrollers 56, 66 for central processing. Preferably, microcontrollers 56, 66 constantly monitor the activation state of the local sensor by receiving electrical signals from the associated microswitches 34, 40 and generate alarm tones through emitters 58, 68, when necessary.

In the preferred embodiment, signals are sent between the microcontrollers over control lines 72, 74 as serial communications to let each know of the others' state and to confirm the presence of the opposite control system. Serial communications are preferred since it is very difficult to access the communications line and inject a serial signal, much more difficult, for example, than injecting a replacement voltage, say, were cord 10 cut. These communications allow the activation of both alarms by the activation of either sensor. Cutting the cable causes signals to be lost between the microcontrollers and also activates the alarms at both ends.

The alarm system may be activated (armed and deactivated by a locking system 70 which communicates with the microcontrollers via signal lines 76, 74 as shown in FIG. 2. This locking system 70 may be manipulated via serial communications with a computer, which may be a portable computer or the alarmed computer. Alternatively, the locking system may be manipulated by infrared or radio signals from a hand-held device in the form of a remote control. Alternatively, a simple mechanical lock activating a circuit may also be employed.

Favourably, these various tasks of the respective control systems 24,26 may be met by an existing microcontroller, namely, the PIC 16C54 microcontroller produced by Microchip Technology Inc. This microcontroller consumes little current yet is capable of generating a 4kHz alarm pulse while at the same time handling the necessary logic functions and asynchronous communication. It will be appreciated by those skilled in the art that other similar microcontrollers exist which could suitably be employed, and it will also be appreciated that similarly-functioning microcontrollers will evolve from these currently existing ones which will also be likely to be utilized.

In addition to these control mechanisms, this microcontroller may accomplish other tasks which might be desired in such a security system. For example, this microcontroller can produce two-tone audio alarms. It can also be programmed to shut the alarm off for a period, then re-start after this period, to save on battery life. It can also draw power from the power line when cord 10 is plugged in, and from the batteries when there is no power. It can also be programmed to continue to sound an alarm even after the alarm-generating event has subsided (ie. even after the electrical device is plugged back in).

In a preferred embodiment, the alarm can be "deactivated" by a variety of means, including a physical key, a combination lock, or an electrical signal provided by acoustic, electrical, electromagnetic or optical means, or any combination thereof. For example, the user might have a remote control from which an infrared signal can be sent to a receiver which would provide an appropriate signal to the microcontrollers to disable the alarm. While it is generally convenient to use a handheld interface, it would also be conveniently possible to use a computer as an interface where cord 10 is the computer power cord.

Of course, those skilled in the art will appreciate that other microcontrollers other than this one, or control circuits might be suitably employed.

As will be apparent to those skilled in the art in the light of the foregoing disclosure, many alterations and modifications are possible in the practice of this invention without departing from the spirit or scope thereof. For example, it will be clear to those skilled in the art that the invention could be implemented in a power bar into which a plurality of devices could be plugged, the alarm being set off upon removal of any one of them. The invention could also be integrated into other electrical equipment typically used with computers, like surge protectors, for example.

Accordingly, the scope of the invention is to be construed in accordance with the substance defined by the following claims.

What is claimed is:

1. An electrical power cord for deterring theft of an electrical device comprising:

a) a first end comprising a male plug having first and second prongs, said plug fashioned to be plugged into a typical electric receptacle;

b) a second end connectable to said electrical device;

c) an electrically-conducting cable connecting said plug and said second end;

d) a first sensor proximate said plug for sensing removal of said plug from said receptacle, said first sensor providing an alarm signal when said plug is removed from said receptacle;

e) a second sensor proximate said second end for sensing removal of said power cord from said electrical device, said second sensor providing an alarm signal when said power cord is removed from said device;

f) a first control system electrically associated with said first sensor, said first control system activating an alarm upon receipt of said alarm signal from said first sensor;

g) a second control system electrically associated with said second sensor, said second control system activating an alarm upon receipt of said alarm signal from said second sensor; and h) electrical communications means connected between said first and second control systems for carrying communications signals produced by each of said control systems between said control systems.

2. An electrical power cord as claimed in claim 1 wherein said plug has a grounding prong and wherein:

a) said first sensor comprises a first rod protruding from said plug;

b) a first end of said rod is attached to a microswitch encased within said plug;

c) said microswitch is electrically coupled to said first control system; and d) said rod is reciprocable between an extended position and a retracted position, the rod when in one of said positions closing said microswitch.

3. An electrical power cord as claimed in claim 2 wherein said first rod is sheathed within said grounding plug.

4. An electrical power cord as claimed in claim 3 wherein said first rod is normally biased into said extended position by a spring, and wherein said rod closes said microswitch when in said extended position, thereby closing an electrical circuit and providing an alarm signal to said control system.

5. An electrical power cord as claimed in claim 4 wherein said first rod is pushed into its retracted position when said plug is plugged into said receptacle.

6. An electrical power cord as claimed in claim 1 wherein said control systems activate an alarm upon interruption of said communications signals.

7. An electric power cord as claimed in claim 6 wherein each of said control systems comprises a microcontroller or other integrated circuits electrically coupled to said microswitch and to said alarm, each microcontroller programmed to accept said alarm signal and to activate an alarm in response to said signal, and programmed to send operational status signals to the other of said microprocessors.

8. An electric power cord as claimed in claim 7 further comprising means for disabling the function of said control systems, preventing said alarm from being activated by said microcontroller.

9. An electric power cord as claimed in claim 8 wherein electrically-powered components of said cord draw power from said receptacle.

10. An electric power cord as claimed in claim 9 further comprising a battery backup system capable of powering said components in the absence of power from said receptacle.

11. An electric power cord as claimed in claim 10 wherein said alarm is an audio signal.

12. An electric power cord as claimed in claim 7 wherein said microcontrollers comprise the PIC16C54 microcontroller produced by Microchip Technology Inc.

13. An electrical power cord as claimed in claim 6 wherein said second end is integrated into said electrical device.

14. An electrical power cord as claimed in claim 13 wherein said control systems are integrated into said electrical device.

15. An electrical power cord as claimed in claim 6 wherein one or both of said control systems activate an acoustic alarm, providing an audible signal.

16. An electrical power cord as claimed in claim 6 wherein one or both of said control systems activate an optical alarm, providing an optical signal detectable by a central alarm system.

17. An electrical power cord as claimed in claim 6 wherein one or both of said control systems activate an electromagnetic alarm, providing an electromagnetic signal detectable by a central alarm system.

18. An electrical power cord as claimed in claim 1 wherein said second end comprises a female socket having first and second current slots and a grounding slot, said socket fashioned to be connected to said electrical device.

19. An electrical power cord as claimed in claim 18 wherein:

a) said second sensor comprises a second rod protruding from said female socket;

b) a first end of said second rod is attached to a microswitch encased within said socket;

c) said microswitch is electrically coupled to said second control system; and d) said second rod is reciprocable between an extended position and a retracted position.

20. An electrical power cord as claimed in claim 19 wherein said second rod is normally biased into said extended position by a spring, and wherein said rod activates said microswitch when in said extended position, thereby providing an alarm signal to said second control system.

21. An electrical power cord as claimed in claim 20 wherein said second rod is pushed into its retracted position when said power cord of said device is plugged into said female socket.

22. An electrical power cord as claimed in claim 18 wherein said sensors in the male plug end detect either the bottom or sides of the prong connector, and wherein said sensors in the female socket end detect the presence of either the end or sides of a male connector.

23. An electrical power cord as claimed in claim 1 wherein at least one of said first and second sensors is an optical distance sensor.

24. An electrical power cord as claimed in claim 1 wherein at least one of said first and second sensors is an acoustical distance sensor.

25. An electrical power cord as claimed in claim 1 wherein said power cord comprises a power bar.

* * * * *